United States Patent [19]

Sauer et al.

[11] 4,314,124

[45] Feb. 2, 1982

[54] PUSHBUTTON CONTACT

[75] Inventors: Heinrich Sauer, Amberg; Herbert Müller, Schwarzenfeld, both of Fed. Rep. of Germany

[73] Assignee: Siemens Aktiengesellschaft, Berlin and Munich, Fed. Rep. of Germany

[21] Appl. No.: 95,332

[22] Filed: Nov. 19, 1979

[30] Foreign Application Priority Data

Dec. 13, 1978 [DE] Fed. Rep. of Germany ..... 2853880

[51] Int. Cl.[3] ..... H01H 9/00

[52] U.S. Cl. ..... 200/328; 200/320; 200/324; 200/325

[58] Field of Search ..... 200/328, 325, 324, 320, 200/77, 78

[56] References Cited

U.S. PATENT DOCUMENTS

| | | | |
|---|---|---|---|
| 2,347,874 | 5/1944 | Bluemle | 200/77 |
| 3,246,111 | 4/1966 | Martens | 200/325 |
| 3,410,973 | 11/1968 | Fraser et al. | 200/77 |
| 3,602,678 | 8/1971 | Laete | 200/328 |

*Primary Examiner*—Willis Little

*Attorney, Agent, or Firm*—Kenyon & Kenyon

[57] ABSTRACT

A pushbutton contactor has means for transforming the contacting function into a locking function or vice versa in which detent means are provided on the actuating member which cooperate with cam surfaces in the guide cylinder of the pushbutton contactor. Different cam surfaces in a guide cylinder are offset from each other and can be brought into operative connection with the detent means. By simple displacement of the actuating member, the function of the pushbutton contact can be changed from a locking to an intermittent contact or vice versa.

8 Claims, 6 Drawing Figures

PUSHBUTTON CONTACT

FIELD OF THE INVENTION

This invention relates to pushbutton contactors having means for transforming a contacting (keying) function into a locking function or vice versa by inserting or removing detent means which are in operative connection with cam surfaces.

BACKGROUND OF THE INVENTION

In a known pushbutton contact of the above mentioned kind described in DE-OS No. 27 43 307, a disk having cam surfaces can be secured on the actuating member and can cooperate with detent means retained on a ring and insertable into the fixed part of the pushbutton contactor, so that a monostable pushbutton can be transformed into a bistable push-pull switch.

This arrangement has the disadvantage that a stock of additional parts must be maintained for use when they may be needed. In addition, disassembly of the entire device is required, since the detent means inside the device are not accessible from the outside. Thus when changing the intermittent contact action to a locking function and vice versa, the actual switching member must be removed from the actuating member. This increases installation costs.

SUMMARY OF THE INVENTION

The present invention provides a pushbutton contactor of the above-mentioned kind which makes possible, without having to use additional parts and without any great installation cost, the change of function from that of a touch contactor into that of a locking switch and vice versa. This is achieved in a simple manner by providing at least one detent means on the actuating member, which can be brought into operative connection with different cam surfaces by turning the actuating member to predetermined anglular positions in the guide cylinder. To prevent jamming of the detent means, it is also preferable to use three such detents which are mutually offset by 120°. Most of the possible requirements with respect to locking and contacting positions can be fulfilled when each detent is associated with three different cam surfaces. The pushbutton contact can be used as a three-position switch when each cam has surfaces which provide one central and two end positions for the actuating member.

It has been found to be a further advantageous combination of the locking/contacting positions when each type of cam, together with the detent, forms two locking positions, so that the actuating member can be moved from a central position to a locking or to a contacting position, or from one central position to two locking positions. It has also been found that guidance of the locking means in the actuating member can be still further improved when the detents consist of sliding elements or tappets which are guided in the actuating member. To ensure reliable correspondence of the locking/contacting positions with the angular position of the actuating member, the actuating member is provided with a stop lug, which is elongated in the direction of actuation and which can be introduced into any one of several guide recesses to fix predetermined angular positions. Marking the guide recesses in colors has proved advantageous in this connection.

DETAILED DESCRIPTION OF THE INVENTION

Figure 1:
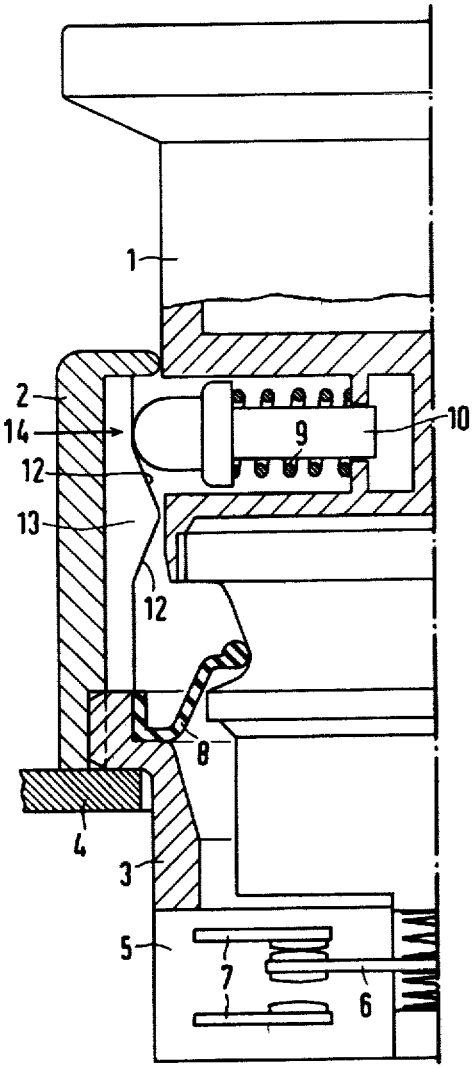
FIG. 1 is a side view, in partial cross-section, of a pushbutton contactor constructed according to the invention and having two locking positions.

The pushbutton contactor shown in FIG. 1 consists of an actuating member 1, which is displaceably guided in a face ring 2. Ring 2 is screwed onto an intermediate ring 3 and is secured to a mounting plate 4 by means of the pushbutton contactor or an associated rosette in a manner not shown in detail in the drawing. Brought into connection with intermediate ring 3 is a switching element 5, which comprises, for example, a spring-loaded contact bridge 6 and associated, fixed contact parts 7. An annular seal 8 serves as a seal between movable actuating member 1 and the fixed parts, such as intermediate ring 3 and face ring 2. The detent means are displaceably mounted in actuating member 1 and appear in FIG. 1 in the form of a slide or sliding pin 10 which is spring loaded by a spring 9 into engagement with an inclined plane or cam surface 12. The detent means can also take the form of spring-loaded balls 11 (as shown in FIG. 3) each of which cooperates with a cam surface 12. Cam surfaces 12 may be formed directly on face ring 2 or they may be formed on a guide cylinder 13 which may be inserted in, and is connectable with, face ring 2. The peripherally located zone, in which cam surfaces planes 12 for the formation of two locking positions on the inner circumference of guide cylinder 13 are carried, bears the reference symbol 14, as may be seen in FIG. 1. Three such zones, mutually offset by 120°, are shown with varied cross-hatchings in FIG. 4. There, the position of actuating member 1 relative to guide cylinder 13 corresponds to the double locking position of the contact illustrated in FIG. 1. In this position, laterally projecting guide stop lug 15 is engaged in recess 16. When lug 15 is moved into recess 17 the contacting function shown in FIG. 3 for the pushbutton contact or is enabled. In this case, the slide tappets or rods 10 are brought into engagement with zones 18 of cylinder 13. Further displacement of guide stop lug 15 into recess 19 results in the locking/contacting position of the pushbutton contactor shown in FIG. 2. This zone bears the reference symbol 20 in FIG. 4. The transposition of guide stop lug 15 into recesses 16, 17, and 19 can be effected in a simple manner by detaching face ring 2, which has a movement limiting stop (not shown in detail) for actuating member 1, so that the relatively short (axially), guide stop lug 15 can be lifted out of, and rotated above, guide cylinder 13 by the predetermined angle, after which it can be pushed into the desired recess. Face ring 2 is then screwed into place again.

Figure 2:
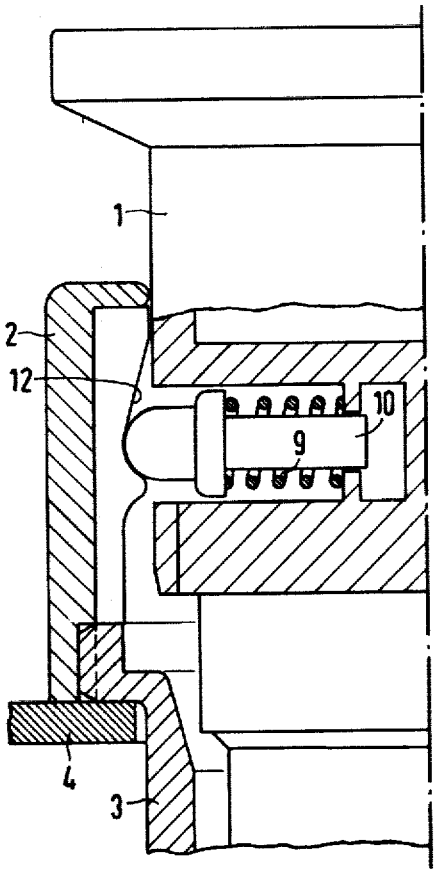
FIG. 2 illustrates a cam profile for forming a locking position when the actuating member is pushed and for forming a contacting position when the actuating member is pulled.
Figure 3:
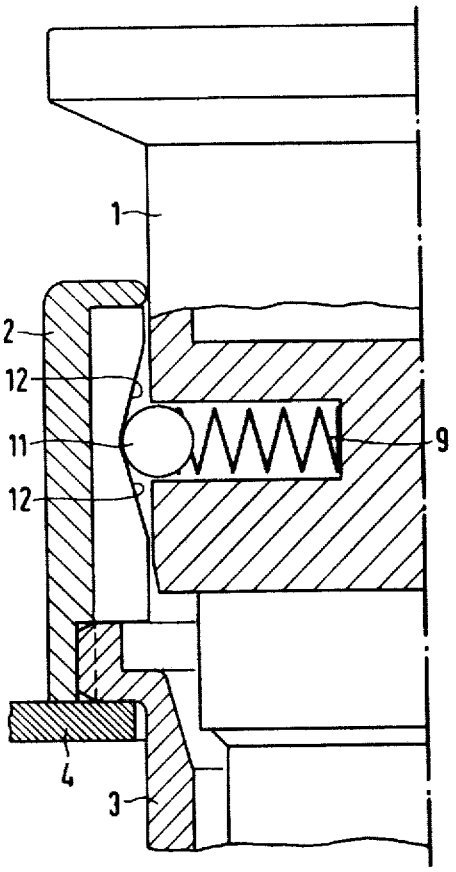
FIG. 3 shows the position of the actuating member relative to the guide cylinder in which contacting positions are produced by pulling as well as by pushing the actuating member.
Figure 5:
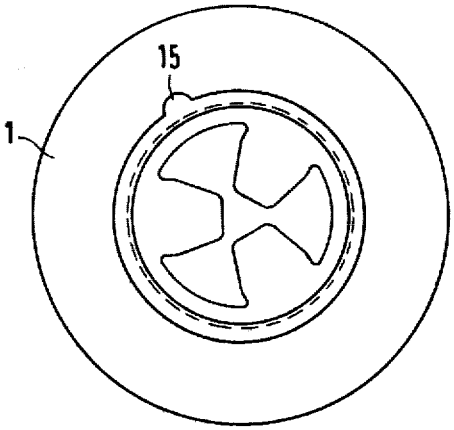
FIGS. 5 and 6, are a plan view and lateral section, respectively, of the actuating member used in the preceding figures.
Figure 6:
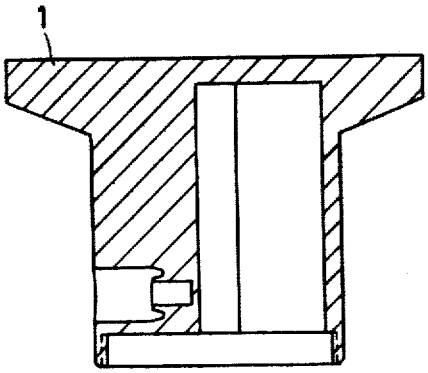
Figure 4:
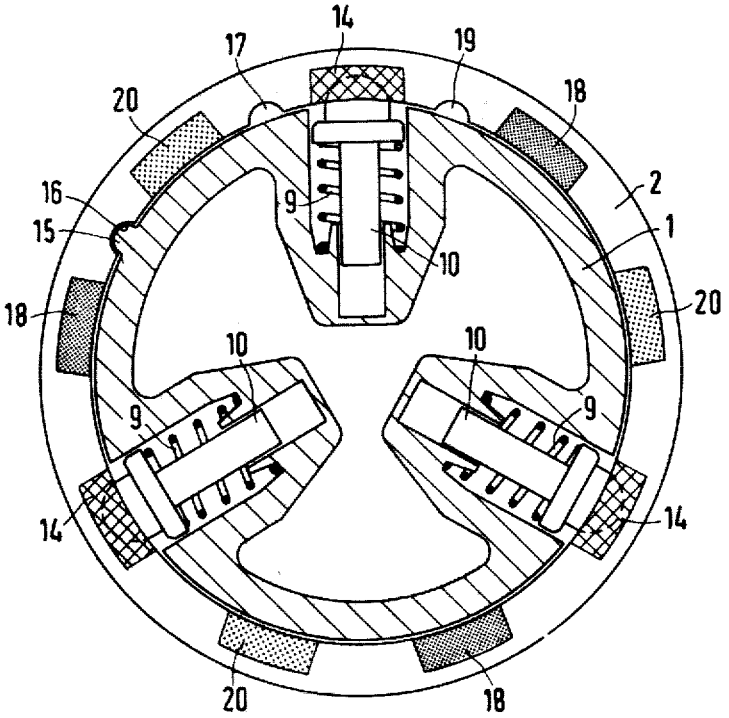
FIG. 4 is a view in cross-section of the contactor of the invention, taken across the axis and showing the predetermined setting angles.

Preferred configurations of cam surfaces, 13 for achieving the different functions may best be seen in FIGS. 1 to 3, where the various forms of the cam surfaces are evident in profile, without further explanation. If actuator 1, in the embodiment of FIG. 1, is depressed, slide tappet 10 snaps over the inward projecting central crest of cam surface 12 and actuator 1 remains depressed, being held by the retention of slide tappet 10 in recessed, lower cam surface 12. To bring the switch back, the mushroom knob of actuating member 1 must be pulled out.

When actuating member 1 is rotated to the position shown in FIG. 2, the body of the actuating member is centrally positioned so that bridge contact 6 is lifted off and no longer contacts the upper of the fixed contact parts 7. Then, when actuating member 1 is pulled out, contact bridge 6 comes into contact with upper fixed contact part 7; it snaps back into the central position shown in FIG. 2 as soon as actuating member 1 is released. If actuating member 1 is depressed, the locking position is reached and return of slide tappet 10 is opposed by the crest of inclined plane 12. Again, return from the locking position must be effected by pulling on actuating member 1.

In contrast, the cam surface of of FIG. 3 has no crests at all, and actuating member 1 will return to the central position after being either pulled or pushed. Here, therefore, two independent contacting positions exist.

It is evident that the cost required for a structure produced in accordance with the invention is relatively low and that the resulting contactor has many more possibilities than those inherent in contactors of the prior art. Note, too, that in an alternative construction, the locking members and the guide stop lug can be mounted in the fixed part, and the associated inclined planes can be provided on the actuating member.

What is claimed is:

1. A push button contactor which is adapted to be changed from a contacting function to a locking function and vice versa comprising:

a support carrying at least first and second cam surfaces each having a different profile; and an actuating member adjacent to the support and carrying at least one detent means, the actuating member being displaceable between operating positions through at least one predetermined angle to bring the detent means into operating engagement with either one of the cam surfaces.

2. A pushbutton contactor according to claim 1, in which there are three detent means on the actuating member which are mutually offset from each other by 120°.

3. A pushbutton contactor according to claim 2, in which a set of cam surfaces having the same profile is associated with each angular position.

4. A pushbutton contactor according to any one of claim 1 and claim 3 in which at least one of the cam surface profiles provides one central and two end positions for the actuating member.

5. A pushbutton contactor according to any one of claim 1 and claim 3 in which one cam surface profile provides a central position from which the actuating member can be transferred to a locking or to a contacting position and another cam surface profile provides a central position from which the actuating member can be transferred to two locking positions.

6. A pushbutton contactor according to claim 4 in which one cam surface profile provides a central position from which the actuating member can be transferred to a locking or a contacting position and one cam surface profile provides a central position from which the actuating member can be transferred to two locking positions.

7. A pushbutton contact according to any one of claim 1 and claim 3 in which each detent means comprises a slide member which is movably guided in the actuating member.

8. A pushbutton contact according to any one of claim 1 and claim 3 and further comprising:

a projecting guide lug on the actuating member; and plural guide recesses in the support for fixing each predetermined angle, each guide recess being adapted to receive the guide lug.

* * * * *